US009916820B2

(12) United States Patent
Inoue

(10) Patent No.: US 9,916,820 B2
(45) Date of Patent: Mar. 13, 2018

(54) SUPPORTER FOR SUPPORTING SOUND TUBES TO BE HUNG THEREFROM AND METHOD OF PRODUCING THE SAME, AND MUSICAL INSTRUMENT

(71) Applicant: YAMAHA CORPORATION, Hamamatsu-shi (JP)

(72) Inventor: Hideyuki Inoue, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/458,301

(22) Filed: Mar. 14, 2017

(65) Prior Publication Data

US 2017/0278494 A1 Sep. 28, 2017

(30) Foreign Application Priority Data

Mar. 22, 2016 (JP) ..... 2016-057315

(51) Int. Cl.
*G10D 13/08* (2006.01)

(52) U.S. Cl.
CPC ..... *G10D 13/08* (2013.01)

(58) Field of Classification Search
CPC ..... G10G 5/005; G10G 13/08
See application file for complete search history.

(56) References Cited

U.S. PATENT DOCUMENTS

| | | | | |
|---|---|---|---|---|
| 1,100,671 | A * | 6/1914 | Deagan | G10D 13/08 84/403 |
| 1,100,672 | A * | 6/1914 | Deagan | G10D 13/08 84/403 |
| 2,647,430 | A * | 8/1953 | Schilling | G10D 13/08 84/405 |
| 3,229,021 | A * | 1/1966 | Baschet | G10D 13/08 84/404 |
| 3,589,233 | A * | 6/1971 | Rowe, Sr. | G10D 13/08 84/402 |
| 4,154,135 | A * | 5/1979 | Haack | G10D 13/08 84/103 |
| 5,329,836 | A * | 7/1994 | Stannard | G10D 13/08 84/402 |
| 5,410,937 | A * | 5/1995 | Okamoto | G10D 13/08 116/169 |
| 2009/0178536 | A1* | 7/2009 | Simons | G10D 13/08 84/402 |
| 2017/0278494 | A1* | 9/2017 | Inoue | G10D 13/08 |

FOREIGN PATENT DOCUMENTS

JP H06149237 A 5/1994

* cited by examiner

*Primary Examiner* — Robert W Horn
(74) *Attorney, Agent, or Firm* — Rossi, Kimms & McDowell LLP

(57) ABSTRACT

A musical instrument includes a supporter for supporting a plurality of sound tubes to be hung therefrom using wires. The supporter includes at least one hanger bar and a plurality of hanger pins extending from the at least one hanger bar toward a hanging side of the at least one hanger bar from which the sound tubes are hung. The at least one hanger bar and the hanger pins are integrally formed in one piece.

20 Claims, 4 Drawing Sheets

SUPPORTER FOR SUPPORTING SOUND TUBES TO BE HUNG THEREFROM AND METHOD OF PRODUCING THE SAME, AND MUSICAL INSTRUMENT

CROSS REFERENCE TO RELATED APPLICATION

The present application claims priority from Japanese Patent Application No. 2016-057315, which was filed on Mar. 22, 2016, the disclosure of which is herein incorporated by reference in its entirety.

BACKGROUND

Technical Field

The following disclosure relates to a supporter for musical instruments which include sound tubes, each as a tubular sound generator, supported by the supporter so as to be hung therefrom.

Description of Related Art

As disclosed in JP-A-6-149237, chimes (which may also be referred to as "tubular bells") are known as one example of percussion instruments by which a melody is played. The chimes include a frame and a plurality of metal tubes (sound tubes) hanging from the frame and having mutually different lengths. The chimes are played by striking the metal tubes to generate sounds of different pitches. Each of the sound tubes of the chimes has through-holes through which a looped hanging cord is threaded for hanging the sound tube from the frame. The frame includes, as a part thereof, a hanger bar disposed at its upper portion. The hanger bar includes: hanger pins each having a vertically extending groove and attached to the hanger bar so as to horizontally extend therefrom; and fixed pins fixed to the upper surface of the hanger bar.

For hanging the sound tube from the hanger bar, the hanging cord is hooked in the groove of the hanger pin, and the hanging cord is then hooked on the fixed pin while the sound tube is supported. When hanging the sound tube in this way, the hanging cord is hooked in the groove formed in the hanger pin. In an instance where an extension direction of the groove is shifted relative to or deviates from the vertical direction, there is a risk that the sound tube is not appropriately hung. Further, such shifting or deviation of the extension direction of the groove may cause an excessive load to act on the hanging cord, resulting in damage or wear of the hanging cord. In view of this, attachment of the hanger pin to the hanger bar is conducted while adjusting an orientation of the hanger pin such that the extension direction of the groove coincides with the vertical direction.

SUMMARY

The hanger pins need to be attached to the hanger bar in accordance with the number of the sound tubes to be hung. Thus, it requires a considerable load to attach the hanger pins to the hanger bar while adjusting the orientations of the individual hanger pins. Not only the chimes, but also various other musical instruments including the supporter and the sound tubes hanging therefrom suffer from this problem.

The present development allows easy production of a supporter of musical instruments for supporting sound tubes to be hung from the supporter.

One aspect of the disclosure relates to a supporter for supporting a plurality of sound tubes to be hung therefrom. The supporter can individually suspend each of the plurality of sound tubes each provide with a wire. The supporter includes at least one hanger bar and a plurality of first hanger pins. The at least one hanger bar is configured to be disposed higher than a tallest one of the plurality of sound tubes. The plurality of first hanger pins are integral with the at least one hanger bar and extend outwardly from one side of the at least one hanger bar from which the plurality of sound tubes are suspendable.

Each of the plurality of first hanger pins is configured to receive the wires from two sound tubes, among the plurality of sound tubes, to enable each of the plurality of first hanger pins to partially suspend the two sound tubes using the wires thereof. Each pair of adjacent hanger pins, among the plurality of first hanger pins, is configured to suspend one of the plurality of tubes using the wire thereof.

The at least one hanger bar is configured to suspend the plurality of sound tubes along two rows.

The supporter further includes a plurality of second hanger pins integral with the at least one hanger bar and extend outwardly from an opposite side of the one side of the least one hanger bar so that the plurality of first hanger pins and the plurality of second pins extend outwardly in opposite directions from the at least one hanger bar.

The at least one hanger bar is configured to extend in a first direction parallel to a horizontal plane, and each of the plurality of first hanger pins extends in a direction parallel to the horizontal plane and perpendicular to the first direction.

The plurality of first hanger pins are configured to suspend a first set of sound tubes, among the plurality of sound tubes, along one of the two rows. The plurality of second hanger pins are configured to suspend a second set of sound tubes, among the plurality of sound tubes, along the other of the two rows. The at least one hanger bar is configured to extend in a first direction parallel to a horizontal plane. Each of the plurality of first hanger pins extends in a second direction parallel to the horizontal plane and perpendicular to the first direction. Each of the plurality of second hanger pins extends in a third direction parallel to the horizontal plane and opposite to the second direction.

The plurality of first hanger pins extend in the second direction from mutually different positions of the at least one hanger bar in the first direction, and the plurality of second hanger pins extend in the third direction from mutually different positions of the at least one hanger bar in the first direction.

Adjacent two of the plurality of first hanger pins are configured to receive the wire of one first sound tube, among the first set of sound tubes, to suspend the one first sound tube, and are spaced apart from each other in the first direction by a distance larger than a width of the one first sound tube. Adjacent two of the plurality of second hanger pins are configured to receive the wire of the one second sound tube, among the second set of sound tubes, to suspend the one second sound tube, and are spaced apart from each other in the first direction by a distance larger than a width of the one second sound tube.

Each of two opposite ends of the wire of each the plurality of sound tubes has an anchor. Each of the plurality of first hanger pins has a first recess at a distal portion thereof sized to receive two anchors from two sound tubes, among the first set of sound tubes. Each of the plurality of second hanger pins has a second recess at a distal portion thereof sized to receive two anchors from two sound tubes, among the second set of sound tubes.

The wire of each of the plurality of sound tubes is looped. Each of the plurality of first hanger pins has a first pair of spaced grooves at a distal portion thereof, and each of the first pair of spaced grooves is configured to receive the looped wire from one of two sound tubes, among the first set of sound tubes. Each of the plurality of second hanger pins has a second pair of spaced grooves at a distal portion thereof, and each of the second pair of spaced grooves is configured to receive the looped wire from one of two sound tubes, among the second set of sound tubes.

The at least one hanger bar comprises a first hanger bar and a second hanger bar attached together so that the first and second hanger bars are configured to extend in the first direction. Each of the plurality of first hanger pins is integral with the first hanger bar and extends from the first hanger bar in the second direction. Each of the plurality of second hanger pins is integral with second hanger bar and extends from the second hanger bar in the third direction.

Each of two opposite ends of the wire of each of the plurality of sound tubes has an anchor. Each of the plurality of first hanger pins is configured to receive two anchors of two sound tubes, among the plurality of sound tubes. Each pair of adjacent hanger pins, among the plurality of first hanger pins, is configured to suspend one of the plurality of tubes using the two anchors thereof.

Each of the plurality of first hanger pins has a recess sized to receive the two anchors from two sound tubes, among the plurality of sound tubes.

Each of the plurality of sound tubes has a looped wire. Each of the plurality of hanger pins is configured to independently seat two looped wires of two sound tubes, among the plurality of sound tubes. Each pair of adjacent hanger pins, among the plurality of hanger pins, is configured to suspend one of the plurality of tubes using the looped wire thereof.

Each of the plurality of hanger pins has a pair of spaced grooves at a distal portion thereof, each of the pair of spaced grooves is configured to receive the looped wire from one of two sound tubes, among the plurality of sound tubes.

Another aspect of the disclosure relates to a musical instrument that incorporates the supporter described above and includes the plurality of sound tubes each with the wire.

Another aspect of the disclosure relates to a method of producing the supporter described above and comprises the steps of die casting an integral one-piece member including a hanger bar and a plurality of hanger pins extending outwardly from one side of the hanger bar to allow each of the plurality sound tubes to be suspended between an adjacent pair of the plurality of hanger pins, and providing a wire at a top end portion of each of the plurality of sound tubes. Each of the plurality of hanger pins is configured to receive the two wires from two sound tubes, among the plurality of sound tubes, to enable each of the hanger pins to partially suspend the two sound tubes using the wires thereof, and each pair of adjacent hanger pins, among the plurality of hanger pins, is configured to suspend one of the plurality of tubes using the wire thereof.

The present disclosure may be embodied in various forms such as a supporter from which the sound tubes are hung, a musical instrument including the chimes that employ the supporter, and a method of producing the supporter.

BRIEF DESCRIPTION OF THE DRAWINGS

The objects, features, advantages, and technical and industrial significance of the present disclosure will be better understood by reading the following detailed description of one embodiment, when considered in connection with the accompanying drawings.

DETAILED DESCRIPTION OF THE EMBODIMENT

A. Structure of Chimes

Figure 1:
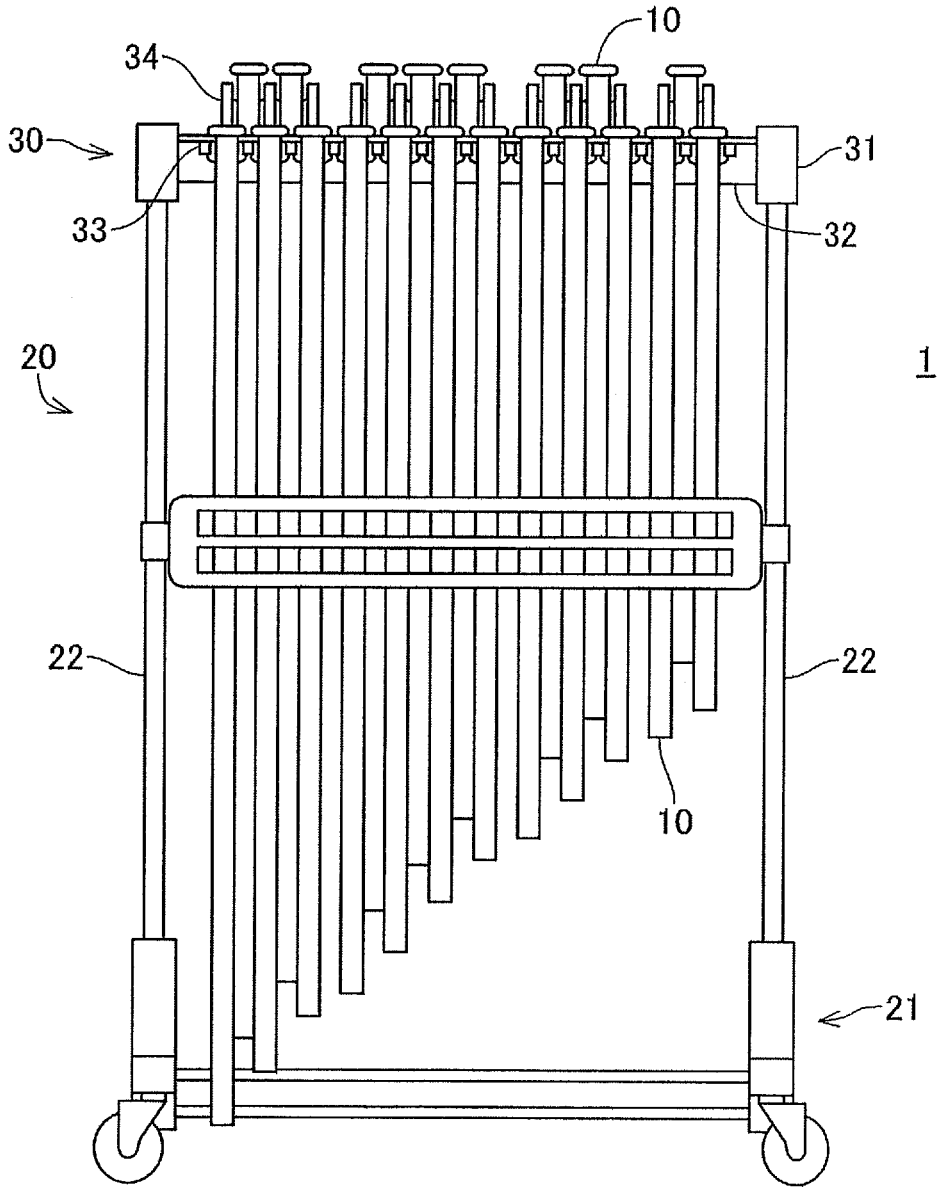
FIG. 1 is a view of chimes according to one embodiment.

FIG. 1 shows chimes 1 (which may also be referred to as "tubular bells") according to one embodiment. FIG. 1 shows the chimes 1 when viewed from a front side. In the following description, "front side" refers to one of opposite sides of the chimes 1 on which a player stands when playing the chimes 1, and the other of the opposite sides of the chimes 1 is referred to as "rear side". In other words, one of opposite sides of the drawing sheet of FIG. 1 corresponding to its front surface is referred to as the front side, and the other of the opposite sides of the drawing sheet of FIG. 1 corresponding to its back surface is referred to as the rear side. Unless otherwise specified, directions such as an up-down direction and a right-left direction are defined with respect a direction in which the player sees the chimes 1 when playing the chimes 1.

The chimes 1 include a plurality of sound tubes 10 (each of which may also be referred to as "sound column") and a frame 20 for hanging the sound tubes 10. The frame 20 includes a leg portion 21, two side columns 22 extending vertically upward from respective right and left ends of the leg portion 21, and a hanger 30 extending between upper ends of the respective two side columns 22. The hanger 30 includes: two side-column mount portions 31 respectively provided at its right and left ends to which the side columns 22 are fixed; and a hanger bar 32 extending between the two side-column mount portions 31. In a state in which the frame 20 is placed on a surface parallel to a horizontal plane, the hanger bar 32 extends in a direction parallel to the horizontal plane, i.e., the right-left direction (as one example of "first direction"). That is, a longitudinal direction of the hanger bar 32 coincides with the direction parallel to the horizontal plane. The chimes 1 further include other elements such as a damper, in addition to the sound tubes 10 and the frame 20. Those elements other than the sound tubes 10 and the hanger 30 are not directly relevant to the present disclosure, and a detailed explanation thereof is omitted.

The hanger bar 32 includes a plurality of hanger pins (front pins) 33 extending forward and a plurality of hanger pins (rear pins) 34 standing upright and extending rearward. The front pins 33 extending forward from the hanger bar 32 may be referred to as the hanger pins belonging to a first hanger-pin group (first group). In an instance where the direction of extension of the hanger bar 32 (i.e., the longitudinal direction of the hanger bar 32) is defined as the first direction, the front pins 33 belonging to the first hanger-pin group extend in a direction perpendicular to the first direction. The front pins 33 of the first hanger-pin group may extend in other directions different from the first direction in which the hanger bar 32 extends. Likewise, the rear pins 34 extending rearward from the hanger bar 32 may be referred to as the hanger pins belonging to a second hanger-pin group (second group). The rear pins 34 belonging to the second hanger-pin group extend in a direction perpendicular to the first direction. The rear pins 34 of the second hanger-pin group may extend in other directions different from the first direction in which the hanger bar 32 extends. It may be expressed that the rear pins 34 of the second hanger-pin group extend in an opposite direction to the direction in which the front pins 33 of the first hanger-pin group extend. It is noted that the rear pins 34 may extend in directions other than the opposite direction. The sound tube 10 is hung by adjacent two front pins 33 or adjacent two rear pins 34 by use of hanging members which will be later described. The sound tubes 10 are supported by the hanger pins 33, 34 provided on the hanger bar 32. Thus, a combination of the hanger pins 33, 34 and the hanger bar 32 may be referred to as a supporter for supporting the sound tubes 10. Further, the hanger 30 as a whole, which includes the side-column mount portions 31 and the hanger bars 32 having the hanger pins 33, 34, supports the sound tubes 10. In this sense, the hanger 30 may be referred to as the supporter.

In the present embodiment, the sound tubes 10 are hung by the front pins 33 extending toward the front side and the rear pins 34 extending toward the rear side. In this configuration, the sound tubes 10 are arranged in two rows respectively on the front side and the rear side of the hanger bar 32, as shown in FIG. 1. Thus, the hanger bar 32 or the hanger 30 supports the sound tubes 10 such that the sound tubes 10 are hung therefrom in two rows (two sound-tube rows). In general, the sound tubes 10 are arranged such that the sound pitch becomes higher from the left to the right and such that the sound tubes 10 for generating natural tones are disposed on the front side while the sound tubes 10 for generating accidental tones are disposed on the rear side. One of the two rows of the sound tubes 10 which are hung by the front pins 33 is referred to as a first sound-tube row (first row), and the other of the two rows of the sound tubes 10 which are hung by the rear pins 34 is referred to as a second sound-tube row (second row). Each of the sound tubes 10 in the first row is interposed between corresponding adjacent two front pins 33, and each of the sound tubes 10 in the second row is interposed between corresponding adjacent two rear pins 34.

B. Hanging Configuration of Sound Tubes on Hanger

Figure 2:
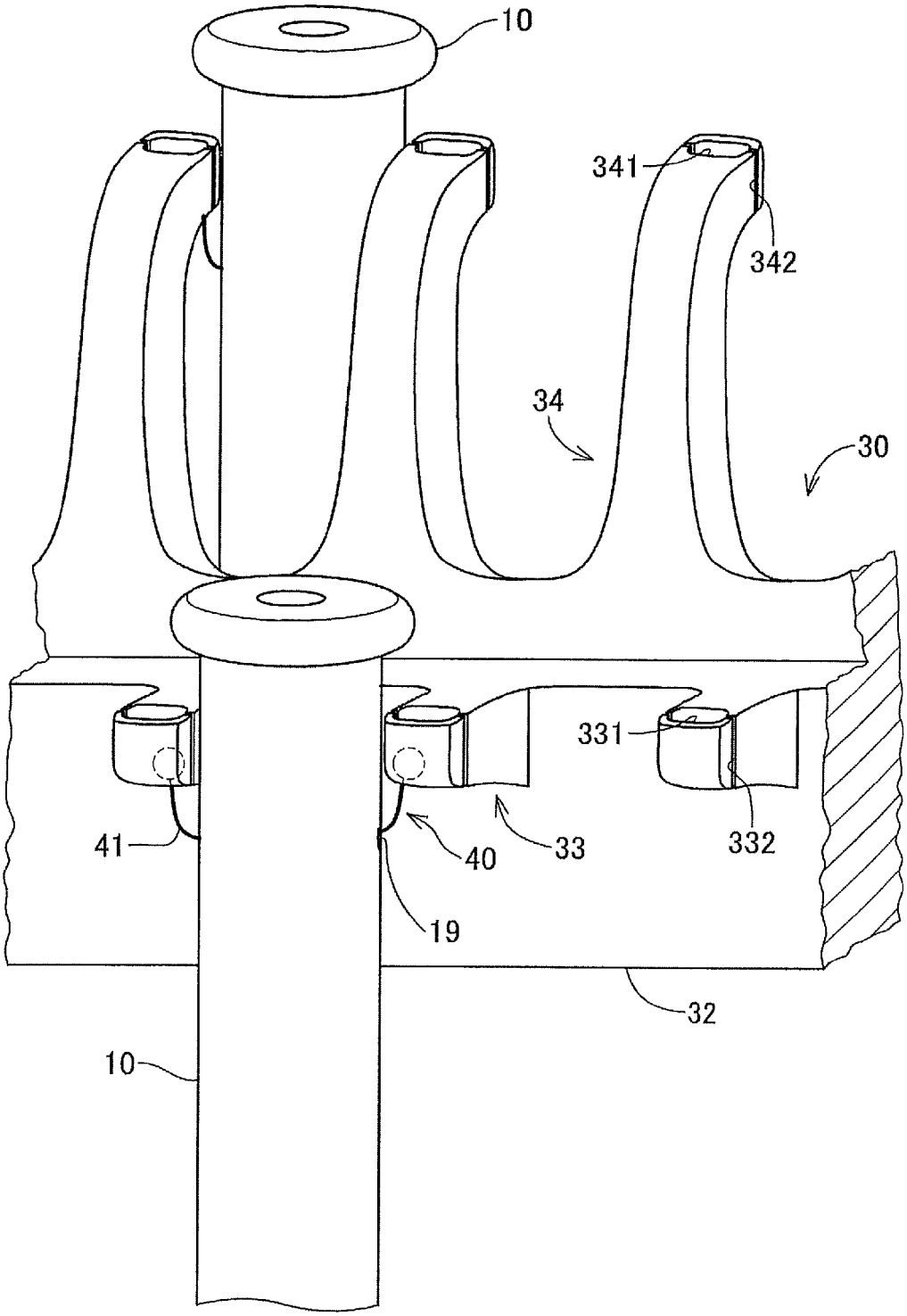
FIG. 2 is a view illustrating sound tubes hanging from a hanger.

FIG. 2 shows the sound tubes 10 hanging from the hanger 30. In FIG. 2, the hanger 30 from which the sound tubes 10 are hung is illustrated in part for the sake of convenience. As described above, the hanger bar 32 includes the front pins 33 extending frontward from the hanger bar 32 and the rear pins 34 standing upright and extending rearward from the hanger bar 32. As apparent from FIG. 2, the front pins 33 extend from the hanger bar 32 toward the front side (hanging side) on which the front-side sound tubes 10 in the first row are hung, and the rear pins 34 extend from the hanger bar 32 toward the rear side (hanging side) on which the rear-side sound tubes 10 in the second row are hung. As described above, because the front pins 33 extend toward the front side and the rear pins 34 extend toward the rear side, it is apparent that the front pins 33 and the rear pins 34 extend from the hanger bar 32 in mutually opposite directions.

Each of the front pins 33 has a recess 331 (as one example of "first engaging portion") opening vertically upward and formed at its distal end portion. Two slits 332 (each as one example of "first engaging portion") are formed at respective positions of the front pin 33 corresponding to the recess 331, such that the slits 332 extend from respective right and left ends of the front pin 33 toward the recess 331. Likewise, each of the rear pins 34 has a recess 341 (as one example of "second engaging portion") opening vertically upward and formed at its distal end portion. Two slits 342 (each as one example of "second engaging portion") are formed at respective positions of the rear pin 34 corresponding to the recess 341, such that the slits 342 extend from respective right and left ends of the rear pin 34 toward the recess 341. Each of the recesses 331, 341 is an oblong hole whose bottom is closed and which has a stadium shape having a longer dimension in the right-left direction. The slits 332 of the front pin 33 extend, in the up-own direction, from the respective right and left ends of the front pin 33 located outward of the corresponding right and left ends of the recess 331, so as to connect upper and lower ends of the front pin 33. The slits 342 of the rear pin 34 are similarly formed.

The sound tube 10 is hung by the two front pins 33 or the two rear pins 34 by use of a hanging member 40 threaded through respective through-holes 19 formed in the sound tube 10. Specifically, in a state in which spherical distal end portions formed integrally with a wire 41 of the hanging member 40 are respectively inserted in the recesses 331 of the respective front pins 33 or the recesses 341 of the respective rear pins 34 each having the closed bottom, the wire 41 of the hanging member 40 passes through the corresponding slit 332 of each front pin 33 or the corresponding slit 342 of each rear pin 34, and the spherical distal end portions of the hanging member 40 are hooked by the recesses 331 and the slits 332 of the front pins 33 or the recesses 341 and the slits 342 of the rear pins 34. The sound tube 10 is hung in this way. The shapes of the front pin and the rear pin and the structure of the hanging member may be changed. For instance, the shape of the recess and the shape of the distal end portion of the hanging member may be changed, and the slit may be formed otherwise. Further, the hanging member may have bushings which are fitted into the respective through-holes 19 of the sound tube 10.

In the sound tubes 10 hung in the two rows, a distance in the front-rear direction between each of the sound tubes 10 in the front row and each of the sound tubes 10 in the rear row and a distance in the up-down direction between each of the sound tube 10 in the front row and each of the sound tubes 10 in the rear row are adjusted by adjusting a spacing between the front pin 33 and the rear pin 34 in the front-rear direction and a length by which the rear pin 34 stands upright from the hanger bar 32.

If the above-indicated distance in the front-rear direction is too small, the sound tubes 10 in the front row and the sound tubes 10 in the rear row may come into contact with each other, causing a risk of sound generation from unintended sound tube/tubes 10. On the other hand, if the above-indicated distance in the front-rear direction is too large, performance using the sound tubes 10 in both of the front row and the rear row will become difficult. In view of this, the distance in the front-rear direction between the sound tube 10 in the front row and the sound tube 10 in the rear row is set preferably to a range of 76-83 mm, and more preferably to a range of 79-82 mm.

If the above-indicated distance in the up-down direction is too small, the sound tubes 10 in the rear row are hidden by the sound tubes 10 in the front row, lowering the visibility of the sound tubes 10 in the rear rows and accordingly deteriorating the playability. On the other hand, if the above-indicated distance in the up-down direction is too large, performance using the sound tubes 10 in both of the front row and the rear row will become difficult. In view of this, the distance in the up-down direction between the sound tube 10 in the front row and the sound tube 10 in the rear row is set preferably to a range of 70-110 mm, and more preferably to a range of 80-100 mm.

In the present embodiment, the sound tubes 10 in the front row are hung by the front pins 33 that extend frontward from the hanger bar 32, and the sound tubes 10 in the rear row are hung by the rear pins 34 that extend rearward from the hanger bar 32, as shown in FIG. 2. With this configuration, the sound tube 10 can be installed on and removed from the hanger bar 32 on an outer side in the extension direction of the hanger pins 33 and on an outer side in the extension direction of the hanger pins 34, namely, on an outer side of each of the two rows of the sound tubes 10 (the first and second sound-tube rows). That is, the sound tubes 10 in the first sound-tube row can be attached to the front pins 33 by moving rearward the sound tubes 10 toward the front pins 33 from the front side of the front pins 33. Likewise, the sound tubes 10 in the second sound-tube row can be attached to the rear pins 34 by moving forward the sound tubes 10 toward the rear pins 34 from the rear side of the rear pins 34.

For attaching each sound tube 10 in this way, the distal end portions of any adjacent two of the front pins 33 need to be spaced apart from each other by a distance larger than the thickness of the sound tube 10 in the first sound-tube row, and the distal end portions of any adjacent two of the rear pins 34 need to be spaced apart from each other by a distance larger than the thickness of the sound tube 10 in the second sound-tube row. The thus disposed front pins 33 and rear pins 34 enable the sound tube 10 to be interposed between the adjacent two front pins 33 or the adjacent two rear pins 34 without a risk of interfering with the front pins 33 or the rear pins 34. The sound tubes 10 can be installed on and removed from the hanger bar 32 on the outer side of each of the two sound-tube rows, whereby installation and removal of the sound tubes 10 can be easily conducted without a need of lifting up the sound tubes 10 higher than the hanger bar 32.

C. Production Method of Hanger

In the hanger 30 of the present embodiment, the hanger pins 33, 34 are formed integrally with the hanger bar 32, as shown in FIG. 2. While not shown, the side-column mount portions 31 (FIG. 1) are also formed integrally with the hanger bar 32. Here, the integral structure refers not to a structure in which individual separable members are assembled, but to a structure which includes no connected portions connected by screwing, fitting, welding or the like. The hanger 30 in which the side-column mount portions 31 and the hanger pins 33, 34 are formed integrally with the hanger bar 32 is produced by die casting.

In the production process of the hanger 30, a metal mold is prepared for casting the entirety of the hanger 30. The metal mold is shaped to provide the side-column mount portions 31, the hanger bar 32, and the hanger pins 33, 34. Molten die-casting alloy is injected into the metal mold. Aluminum alloy, magnesium alloy, or zinc alloy is used as the alloy for die casting. It is, however, preferable to use aluminum alloy to avoid an increase in the weight and the production cost of the hanger 30. After the molten die casting alloy injected into the metal mold has been solidified, the solidified die-casting alloy, i.e., a cast article, is taken out of the metal mold.

The cast article taken out of the metal mold is an integral one-piece article in which the hanger bar 32 and the hanger pins 33, 34 are formed. Finishing work, such as cutting sprues formed in the passages through which the molten metal has flowed and removing fins or burrs, is performed on the cast article, so that the hanger 30 as a final product is obtained. In this way, the hanger 30 is produced in which the side-column mount portions 31, the hanger bar 32, and the hanger pins 33, 34 (i.e., the front pins 33 and the rear pins 34) are integrally formed. The hanger 30 may be produced using a metal mold which is shaped not to give the recesses 331, 341 and the slits 332, 342, and an obtained cast article which do not have the recesses 331, 341 and the slits 332, 342 may be subjected to machining or the like for forming the recesses 331, 341 and the slits 332, 342.

As long as the hanger 30 is formed in one-piece, the hanger 30 may be produced by casting methods other than die casting. For instance, the hanger 30 may be produced by metal mold casting in which molten metal is poured into a metal mold without being pressurized or sand mold casting in which molten metal is poured into a sand mold. The hanger 30 is preferably produced by die casting for allowing the shape of the cast article to be made close to that of the hanger 30 as a final product and for simplifying finishing work performed after casting. The hanger 30 may be produced by forging. It is, however, not easy to produce the hanger 30 by forging because the hanger 30 has a complicated shape. In view of this, it is preferable to produce the hanger 30 by casting.

In general, each of the hanger pins needs to be attached to the hanger bar in a predetermined posture according to its shape, such as a posture in which the opening of the recess 331, 341 is directed vertically upward in the example of FIG. 2. Further, the hanger pins need to be attached to the hanger bar in accordance with the number of the sound tubes to be hung therefrom. In an instance where the hanger bar is formed separately from the hanger pins, it is necessary to attach a large number of hanger pins to the hanger bar with orientations of the individual hanger pins aligned with one another, requiring much labor in assembling work of the hanger bar and the hanger pins. In the present embodiment, on the contrary, the hanger 30 is formed in one piece by die casting, eliminating the laborious process of attaching the hanger pins 33, 34 to the hanger bar 32. It is consequently possible to reduce the load required for producing the hanger 30 with the hanger pins 33, 34.

Though the side-column mount portions 31, the hanger bar 32, and the hanger pins 33, 34 are integrally formed in the hanger 30 of the present embodiment, it is generally desirable that the hanger bar 32 and the hanger pins 33, 34 be integrally formed. For example, the hanger bar 32 formed integrally with the hanger pins 33, 34 may be produced separately from the side-column mount portions 31, and the hanger bar 32 and the side-column mount portions 31 may be assembled into the hanger 30. This arrangement also eliminates the process of attaching a large number of the hanger pins 33, 34 to the hanger bar 32, resulting in easy production of the hanger 30 with the hanger pins 33, 34.

D. Modification of Hanging Configuration of Sound Tubes

Figure 3:
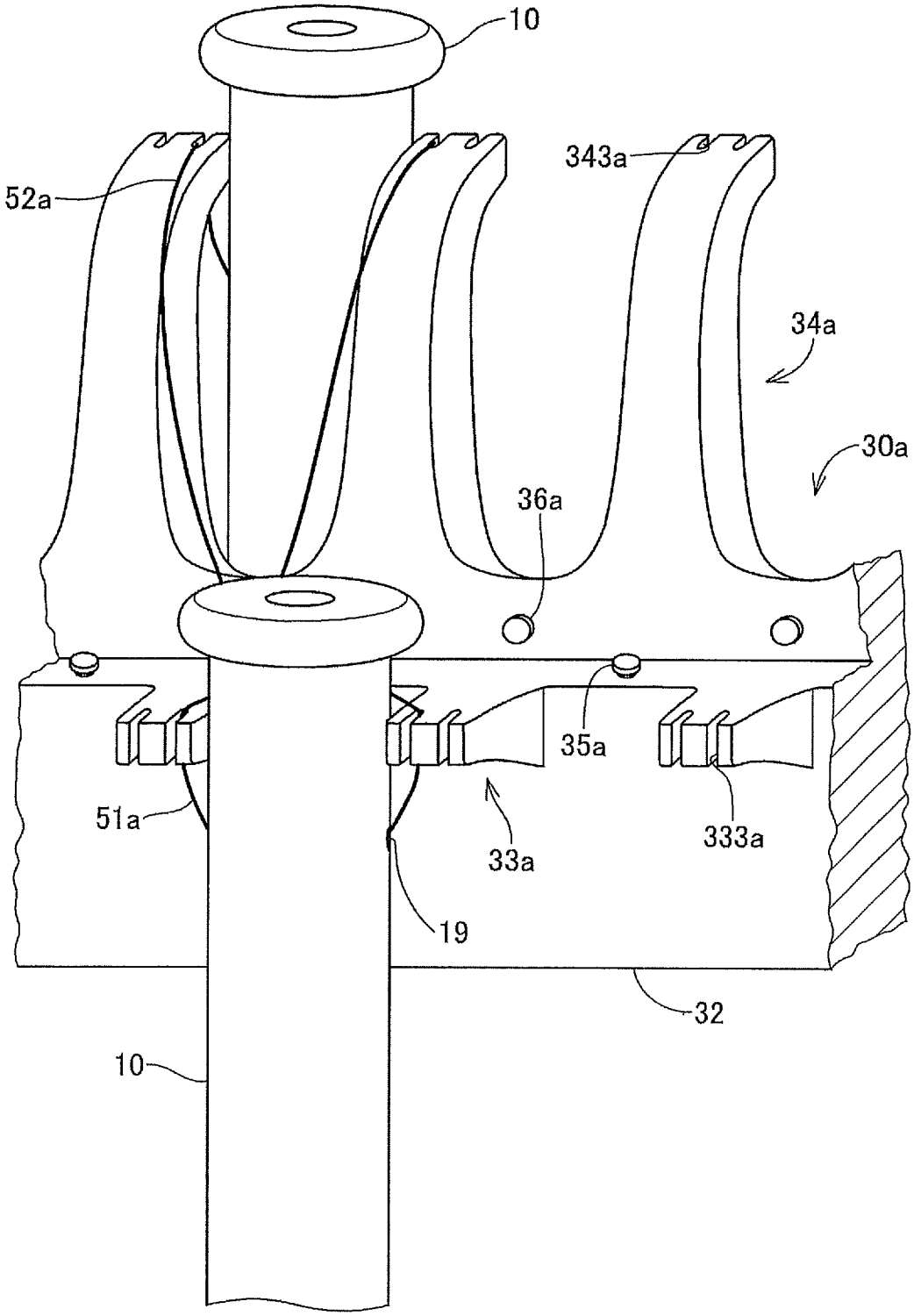
FIG. 3 is a view illustrating the sound tubes hanging from the hanger in a manner different from FIG. 1.

FIG. 3 shows the sound tubes 10 hung from the hanger bar 32 in a manner different from that shown in FIG. 2. This modification differs from the embodiment illustrated above in the shape of front pins 33*a* extending frontward from the hanger bar 32 and the shape of rear pins 34*a* extending rearward from the hanger bar 32. Further, this modification differs from the embodiment illustrated above in that the sound tube 10 is hung from the front pins 33*a* or the rear pins 34*a* by use of a looped hanging wire 51*a*, 52*a*. In this modification, the front pin 33*a* is one example of the hanger pin belonging to the first group while the rear pin 34*a* is one example of the hanger pin belonging to the second group.

As shown in FIG. 3, the front pin 33*a* has two vertically extending grooves 333*a* (each as one example of "first engaging portion"). The hanger bar 32 includes hook rivets 35*a* (each as one example of "first engaging portion") each of which is attached to the hanger bar 32 at a mid-position between corresponding adjacent two front pins 33*a*. The looped hanging wire 51*a* is hooked on the hook rivet 35*a*. The rear pin 34*a* has two vertically extending grooves 343*a*

(each as one example of "second engaging portion"). The hanger bar 32 includes hook rivets 36*a* (each as one example of "second engaging portion") each of which is attached to the hanger bar 32 at a mid-position between corresponding adjacent two rear pins 34*a*. The looped hanging wire 52*a* is hooked on the hook rivet 36*a*.

As shown in FIG. 3, the hanging wire 51*a*, 52*a* threaded through the through-holes 19 of the sound tube 10 is hooked in the grooves 333*a* of the respective adjacent two front pins 33*a* or the grooves 343*a* of the respective adjacent two rear pins 34*a*, and the hanging wire 51*a*, 52*a* is hooked onto the hook rivet 35*a*, 36*a*, whereby the sound tube 10 is hung from the two front pins 33*a* or the two rear pins 34*a*. The shapes and the positions of the front pin, the rear pin, and the hook rivet may be changed. For instance, each of the front pin 33*a* and the rear pin 34*a* may be divided into two parts in the right-left direction, and hanger pins each having a single groove may be disposed so as to be adjacent to each other in the right-left direction.

Also in this modification, the sound tubes 10 can be installed on and removed from the hanger bar 32 on the outer side in each of the extension directions of the hanger pins 33*a*, 34*a*, namely, on the outer side of each of the two sound-tube rows. Thus, the installation and removal of the sound tube 10 can be easily conducted without lifting up the sound tube 10 higher than the hanger bar 32. Further, the hook rivets 35*a*, 36*a* on which the hanging wires 51*a*, 52*a* are hooked are attached to the hanger bar 32 as shown in FIG. 3, so that a space is formed frontward of the sound tubes 10. Consequently, even when the hanging wires 51*a*, 52*a* described above are used for hanging the sound tubes 10, the chimes 1 can be played without interference with the hanging wires 51*a*, 52*a*.

In the hanger 30*a* shown in FIG. 3, the hanger pins 33*a*, 34*a*, namely, the front pins 33*a* and the rear pins 34*a*, are formed integrally with the hanger bar 32. It is thus possible to easily produce the hanger 30*a* (i.e., the supporter) having the hanger bar 32 with the hanger pins 33*a*, 34*a*.

E. Modifications

It is to be understood that the present disclosure is not limited to the details of the embodiment but may be otherwise modified without departing from the scope of the disclosure defined in the attached claims.

E1. First Modification

Figure 4:
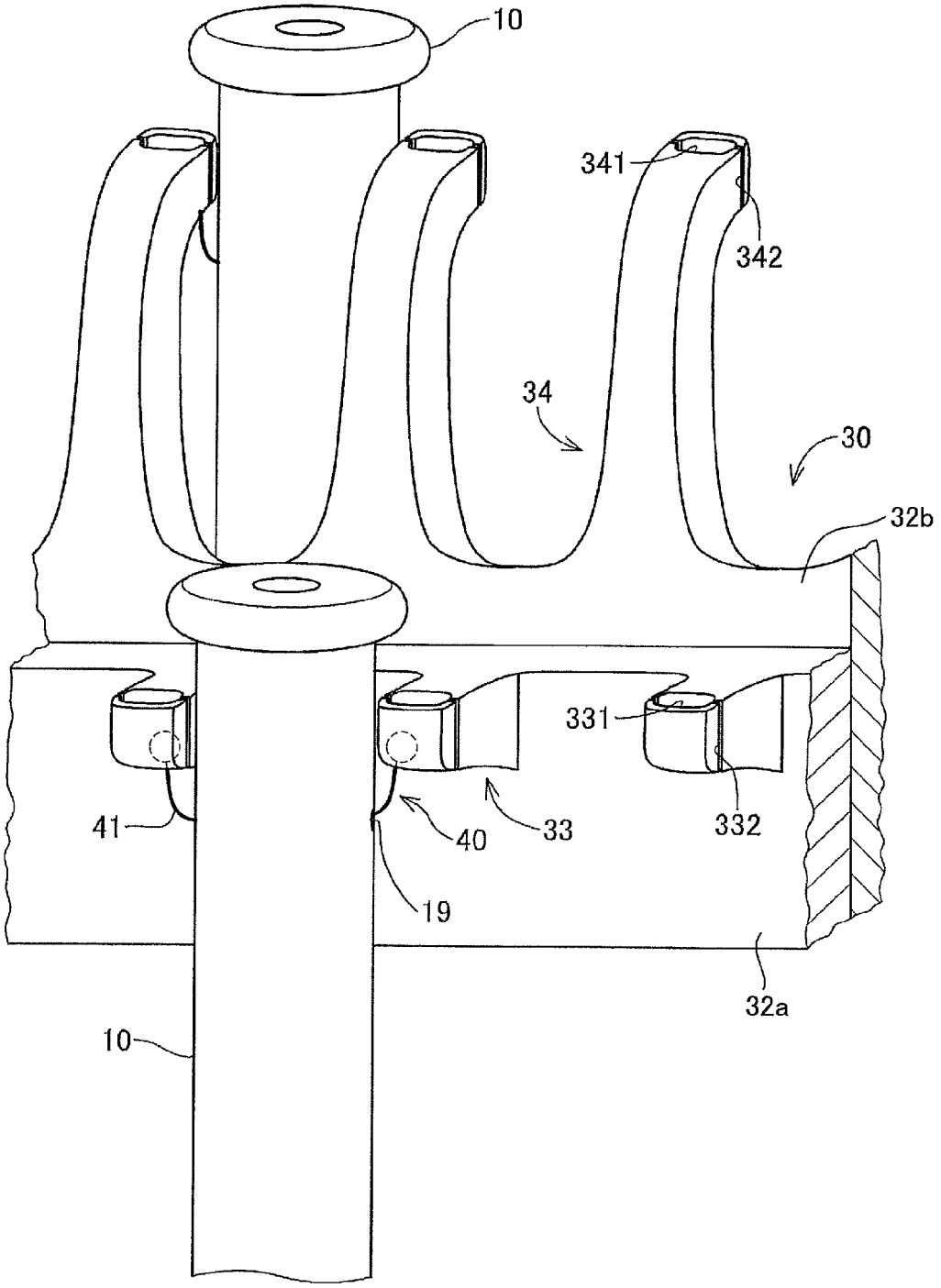
FIG. 4 is a view of a hanger according to another embodiment and the sound tubes hanging therefrom.

In the embodiment illustrated above and the modification of the hanging configuration, the sound tubes 10 in the front row and the rear row are hung by the front pins 33, 33*a* and the rear pins 34, 34*a* provided on the single hanger bar 32. The sound tubes 10 in the front row and the rear row may be hung by the hanger pins provided on different hanger bars. As shown in FIG. 4, the hanger bar 30 may be constituted by a hanger bar 32*a* (front hanger bar 32*a*) from which the hanger pins 33 extend frontward and a hanger bar 32*b* (rear hanger bar 32*b*) from which the hanger pins 34 extend rearward. The two hanger bars 32*a*, 32*b* are arranged in the front-rear direction. As shown in FIG. 4, the front hanger bar 32*a* is disposed on the front side, and the rear hanger bar 32*b* is disposed on the rear side, so that the sound tubes 10 can be easily installed on and removed from the hanger bars 32*a*, 32*b* on the outer side of each sound-tube row. Also in the first modification, the front pins 33 are formed integrally with the front hanger bar 32*a*, and the rear pins 34 are formed integrally with the rear hanger bar 32*b* for easy production of the hanger bars and the hanger. The front hanger bar 32*a* and the rear hanger bar 32*b* need to be fixed to each other as shown in FIG. 4 by a fixing member (not shown) at the time of performance. In terms of simplification of the overall shape of the hanger bar and the hanger and easy production of the supporter, it is preferable that both of the front pins 33, 33*a* and the rear pins 34, 34*a* be formed on the single hanger bar 32 as in the embodiment illustrated above. Alternatively, one hanger bar having the hanger pins extending frontward therefrom and another hanger bar having the hanger pins extending rearward therefrom may be disposed so as to be arranged in the up-down direction and may be fixed to each other by a fixing member.

Alternatively, two hanger bars each of which has the hanger pins extending frontward therefrom may be disposed so as to be spaced apart from each other in both of the front-rear direction and the up-down direction. This configuration, however, makes it difficult installation of the sound tube 10 because the sound tube 10 needs to be lifted up higher than the hanger bars when installed. In this configuration, the hanger pins are formed integrally with the hanger bar for easy production of the hanger bar and the hanger.

E2. Second Modification

In the illustrated embodiment, the disclosure is applied to the chimes 1 including the sound tubes 10 arranged in the two rows, namely, the front row and the rear row. It is to be understood that the disclosure is applicable to chimes including the sound tubes 10 arranged in a single row or a chimes including a single sound tube 10. It is further to be understood that the disclosure is applicable to not only the chimes (the tubular bells) but also various musical instruments in which sound tubes, each of which is a tubular sound generator, are hung from the supporter.

What is claimed is:

1. A supporter for individually suspending each of a plurality of sound tubes each provide with a wire, the supporter comprising:

at least one hanger bar configured to be disposed higher than a tallest one of the plurality of sound tubes; and a plurality of first hanger pins integral with the at least one hanger bar and extending outwardly from one side of the at least one hanger bar from which the plurality of sound tubes are suspendable, wherein each of the plurality of first hanger pins is configured to receive the wires from two sound tubes, among the plurality of sound tubes, to enable each of the plurality of first hanger pins to partially suspend the two sound tubes using the wires thereof, and wherein each pair of adjacent hanger pins, among the plurality of first hanger pins, is configured to suspend one of the plurality of tubes using the wire thereof.

2. The supporter according to claim 1, wherein the at least one hanger bar is configured to suspend the plurality of sound tubes along two rows.

3. The supporter according to claim 2, further comprising a plurality of second hanger pins integral with the at least one hanger bar and extending outwardly from an opposite side of the one side of the least one hanger bar so that the plurality of first hanger pins and the plurality of second pins extend outwardly in opposite directions from the at least one hanger bar.

4. The supporter according to claim 1, wherein:

the at least one hanger bar is configured to extend in a first direction parallel to a horizontal plane, and each of the plurality of first hanger pins extends in a direction parallel to the horizontal plane and perpendicular to the first direction.

5. The supporter according to claim 3, wherein:

the plurality of first hanger pins are configured to suspend a first set of sound tubes, among the plurality of sound tubes, along one of the two rows, the plurality of second hanger pins are configured to suspend a second set of sound tubes, among the plurality of sound tubes, along the other of the two rows, the at least one hanger bar is configured to extend in a first direction parallel to a horizontal plane, each of the plurality of first hanger pins extends in a second direction parallel to the horizontal plane and perpendicular to the first direction, and each of the plurality of second hanger pins extends in a third direction parallel to the horizontal plane and opposite to the second direction.

6. The supporter according to claim 5, wherein:

the plurality of first hanger pins extend in the second direction from mutually different positions of the at least one hanger bar in the first direction, and the plurality of second hanger pins extend in the third direction from mutually different positions of the at least one hanger bar in the first direction.

7. The supporter according to claim 6, wherein:

adjacent two of the plurality of first hanger pins are configured to receive the wire of one first sound tube, among the first set of sound tubes, to suspend the one first sound tube, and are spaced apart from each other in the first direction by a distance larger than a width of the one first sound tube, and adjacent two of the plurality of second hanger pins are configured to receive the wire of the one second sound tube, among the second set of sound tubes, to suspend the one second sound tube, and are spaced apart from each other in the first direction by a distance larger than a width of the one second sound tube.

8. The supporter according to claim 7, wherein:

each of two opposite ends of the wire of each the plurality of sound tubes has an anchor, each of the plurality of first hanger pins has a first recess at a distal portion thereof sized to receive two anchors from two sound tubes, among the first set of sound tubes, and wherein each of the plurality of second hanger pins has a second recess at a distal portion thereof sized to receive two anchors from two sound tubes, among the second set of sound tubes.

9. The supporter according to claim 7, wherein:

the wire of each of the plurality of sound tubes is looped, each of the plurality of first hanger pins has a first pair of spaced grooves at a distal portion thereof, each of the first pair of spaced grooves is configured to receive the looped wire from one of two sound tubes, among the first set of sound tubes, and each of the plurality of second hanger pins has a second pair of spaced grooves at a distal portion thereof, each of the second pair of spaced grooves is configured to receive the looped wire from one of two sound tubes, among the second set of sound tubes.

10. The supporter according to claim 5, wherein:

the at least one hanger bar comprises a first hanger bar and a second hanger bar attached together so that the first and second hanger bars are configured to extend in the first direction, each of the plurality of first hanger pins is integral with the first hanger bar and extends from the first hanger bar in the second direction, and each of the plurality of second hanger pins is integral with second hanger bar and extends from the second hanger bar in the third direction.

11. The supporter according to claim 1, wherein:

each of two opposite ends of the wire of each of the plurality of sound tubes has an anchor, each of the plurality of first hanger pins is configured to receive two anchors of two sound tubes, among the plurality of sound tubes, and each pair of adjacent hanger pins, among the plurality of first hanger pins, is configured to suspend one of the plurality of tubes using the two anchors thereof.

12. The supporter according to claim 11, wherein each of the plurality of first hanger pins has a recess sized to receive the two anchors from two sound tubes, among the plurality of sound tubes.

13. The supporter according to claim 1, wherein:

each of the plurality of sound tubes has a looped wire, each of the plurality of hanger pins is configured to independently seat two looped wires of two sound tubes, among the plurality of sound tubes, and each pair of adjacent hanger pins, among the plurality of hanger pins, is configured to suspend one of the plurality of tubes using the looped wire thereof.

14. The supporter according to claim 13, wherein each of the plurality of hanger pins has a pair of spaced grooves at a distal portion thereof, each of the pair of spaced grooves is configured to receive the looped wire from one of two sound tubes, among the plurality of sound tubes.

15. A musical instrument comprising:

a plurality of sound tubes each with a wire; and a supporter configured to individually suspend each of the plurality of sound tubes using the wires thereof and comprising:

at least one hanger bar configured to be disposed higher than a tallest one of the plurality of sound tubes; and a plurality of first hanger pins integral with the at least one hanger bar and extending outwardly from one side of the at least one hanger bar toward a hanging side of the at least one hanger bar from which the plurality of sound tubes are suspended, wherein each of the plurality of first hanger pins is configured to receive the two wires from two sound tubes, among the plurality of sound tubes, to enable each of the plurality of hanger pins to partially suspend the two sound tubes using the wires thereof, and wherein each pair of adjacent hanger pins, among the plurality of hanger pins, is configured to suspend one of the plurality of tubes using the wire thereof.

16. The musical instrument according to claim 15, wherein:

each of two opposite ends of the wire of each of the plurality of sound tubes has an anchor, each of the plurality of hanger pins is configured to receive two anchors of two sound tubes, among the plurality of sound tubes, and each pair of adjacent hanger pins, among the plurality of hanger pins, is configured to suspend one of the plurality of tubes using the two anchors thereof.

17. The musical instrument according to claim 16, wherein each of the plurality of hanger pins has a recess at a distal portion thereof sized to receive two anchors of two sound tubes, among the plurality of sound tubes.

18. The musical instrument according to claim 15, wherein:

the wire of each of the plurality of sound tubes is looped, each of the plurality of hanger pins is configured to independently seat two looped wires of two sound tubes, among the plurality of sound tubes, and each pair of adjacent hanger pins, among the plurality of hanger pins, is configured to suspend one of the plurality of tubes using the looped wire thereof.

19. The musical according to claim 18, wherein each of the plurality of hanger pins has a pair of spaced grooves at a distal portion thereof, each of the pair of spaced grooves being configured to receive the looped wire from one of two sound tubes, among the plurality of sound tubes.

20. A method of producing a supporter for independently suspending each of a plurality of sound tubes, the method comprising the steps of:

die casting an integral one-piece member including a hanger bar and a plurality of hanger pins extending outwardly from one side of the hanger bar to allow each of the plurality sound tubes to be suspended between an adjacent pair of the plurality of hanger pins; and providing a wire at a top end portion of each of the plurality of sound tubes, wherein each of the plurality of hanger pins is configured to receive the two wires from two sound tubes, among the plurality of sound tubes, to enable each of the hanger pins to partially suspend the two sound tubes using the wires thereof, and wherein each pair of adjacent hanger pins, among the plurality of hanger pins, is configured to suspend one of the plurality of tubes using the wire thereof.

* * * * *